US006150899A

United States Patent [19]

Seewig et al.

[11] Patent Number: 6,150,899

[45] Date of Patent: Nov. 21, 2000

[54] POLARIZER FOR TWO DIFFERENT FREQUENCY BANDS

[75] Inventors: Udo Seewig, Langenhagen; Reimer Nagel, Hannover; Daniel Wojtkowiak, Neustadt, all of Germany

[73] Assignee: Alcatel, Paris, France

[21] Appl. No.: 09/129,962

[22] Filed: Aug. 6, 1998

[30] Foreign Application Priority Data

Aug. 16, 1997 [DE] Germany ..... 197 35 547

[51] Int. Cl.[7] ..... H01P 1/161; H01P 1/213

[52] U.S. Cl. ..... 333/126; 333/135; 333/21 A; 343/756

[58] Field of Search ..... 333/126, 129, 333/135, 137, 21 A; 343/756

[56] References Cited

U.S. PATENT DOCUMENTS

| | | | |
|---|---|---|---|
| 3,274,604 | 9/1966 | Lewis | 343/858 X |
| 4,047,128 | 9/1977 | Morz . | |
| 4,467,294 | 8/1984 | Janky et al. | 333/126 |
| 4,837,531 | 6/1989 | Gourlain et al. | 333/135 |
| 4,956,622 | 9/1990 | de Ronde . | |

FOREIGN PATENT DOCUMENTS

| | | | |
|---|---|---|---|
| 0 096 461 A2 | 4/1983 | European Pat. Off. . | |
| 2 518 822 | 6/1983 | France . | |
| 59-131201 | 7/1984 | Japan . | |
| 2 188 493 | 9/1987 | United Kingdom . | |
| 2188493 | 9/1987 | United Kingdom | 333/21 A |

OTHER PUBLICATIONS

Boifot, Anton M.: "Classification of Ortho–Mode Transducers", European Transactions on Telecommunications and Related Technologies, , vol. 2, N. 5, Sep. 1, 1991, pp. 35–42, XP000266379.

Das, B.N. et al: "A Rigorous Variational Formulation fo an H Plane Slot–Coupled Tee Junction", IEEE Transactions on Microwave Theory and Techniques, 38(1990) Jan. #1, N.Y.

MA, Z. et al: "Efficient Characterization of Complex H–Plane Waveguide PI–Junction and Cross–Junctions", IEICE Transactions on Electronics, vol. E79–C, No. 3, Mar. 1996.

*Primary Examiner*—Benny Lee
*Attorney, Agent, or Firm*—Ware, Fressola, Van der Sluys & Adolphson LLP

[57] ABSTRACT

A polarizer for two different frequency bands for exciting an antenna with a parabolic reflector has a waveguide section capable of carrying in each frequency band two mutually perpendicularly linearly polarized waves. For each frequency band, there are connected to the waveguide section, separate from each other and mutually offset in the axial direction of the waveguide section, two waveguides having a rectangular cross-section. For the lower frequency band, for each polarization direction, a respective waveguide is connected directly to the waveguide section. For the higher frequency band, starting at a connecting point, each of the two waveguides is subdivided into two waveguide branches with identical rectangular cross-sections, with the branches terminating at two opposing locations of the waveguide section. The locations, where the branches for the two different polarization directions terminate on the waveguide section, are circumferentially offset relative to each other by 90°. A metal pin is located in each of the flat waveguide branches in a respective aperture thereof.

3 Claims, 2 Drawing Sheets

POLARIZER FOR TWO DIFFERENT FREQUENCY BANDS

BACKGROUND OF THE INVENTION

1. Technical Field

The invention relates to a polarizer for two different frequency bands for exciting an antenna with a parabolic reflector, comprising a waveguide section capable of carrying in each frequency band two mutually perpendicularly linearly polarized waves, wherein for each frequency band there are connected to the waveguide section separate from each other and mutually offset in the axial direction of the waveguide section two waveguides having a rectangular cross-section, wherein for the lower frequency band for each polarization direction a respective waveguide is connected directly to the waveguide section, wherein for the higher frequency band—starting at a connecting point—each of the two waveguides is subdivided into two branches with identical rectangular cross-sections, with the branches terminating at two opposing locations of the waveguide section, and wherein the locations where the branches for the two different polarization directions terminate on the waveguide section, are circumferentially offset relative to each other by 90°.

2. Description of the Prior Art

Polarizers are used, for example, for exciting antennae with a parabolic reflector for line of sight radio communication, satellite communication or radio location. Polarizers can be used for either exciting the reflector through a sub-reflector (for example, Cassegrain principle) or for directly illuminating the reflector. In the following, "excitation" shall denote both transmission directions of the electro-magnetic waves, i.e. transmitted as well as received waves. In polarizers of this type, two linearly polarized electro-magnetic waves of the same frequency band are guided so that their polarization directions are orthogonal to each other. The two waves therefore do not interfere. Polarizers for a single frequency band or for two different frequency bands are known in the art.

GB 2,117,980 A1 describes a polarizer for two different frequency bands. The polarizer has two regions with circular cross-sections which are the arranged one after the other and have different inside diameters. Two waveguides are connected to each of these regions. Moreover, the region with the larger inside diameter has two different inside diameters wherein the two waveguides of this region terminate in areas having different inside diameters. This polarizer is very expensive to manufacture because the two differently sized regions have to be combined individually while observing very tight tolerances.

In the known polarizer described in EP 0 096 461 B1, the waveguides for the higher frequency band are subdivided, starting at a connection point, into two branches which are terminated in the waveguide section at diametrically opposed points. The connection point is formed as a T-shaped hybrid coupler and provided with two connections. In normal operation, the respective waveguide is coupled in phase via one of the connections which is coupled via a waveguide section to the hybrid coupler. The other connection which is not in phase, is covered with a short-circuit plate. The construction of the polarizer is very costly, in particular in the region adapted for the higher frequency band, which requires two hybrid couplers with the connected waveguide and two additional connections which have to be covered, for example, by short circuit plates. These components also add to the weight, making the installation of the polarizer on the reflector of an antenna more difficult.

SUMMARY OF THE INVENTION

It is the object of the present invention to simplify the construction of the polarizer described above.

The object is solved by the invention in

- that for both polarization planes of the higher frequency band each of the two branches is formed as a one-piece flat waveguide with rectangular cross-section and connected on both ends to the polarizer,
- that equidistant from the ends of the flat waveguide there is attached to the narrow side of each flat waveguide a front face of a straight waveguide portion which has the same rectangular cross-section as the flat waveguide and extends perpendicular from and coplanar with the flat waveguide, wherein the respective waveguide can be connected to the free end of the straight waveguide portion,
- that in the wall of each of the flat waveguides there is disposed a respective aperture which is symmetrically surrounded by the waveguide portion, for providing low reflectivity matching, and
- that in the extension of the waveguide portion and symmetrical to the aperture there is located in each of the flat waveguides a metal pin which extends parallel to and over the entire height of the narrow sides of the respective flat waveguide and which is spaced from the wall of the flat waveguide opposite of the aperture by a distance which is equal to one quarter of the average wavelength of the waves guided in the waveguides connected thereto.

The polarizer is of simple construction not only in the region provided for the lower frequency band, but also in the region provided for the higher frequency band. Each waveguide has only one connection for each polarization direction which at the same time functions as a connection point. Both branches which are combined as a single piece in a flat waveguide, are directly connected to this connection point which also operates as a power splitter. No additional components or materials are therefore required to conveniently feed the waves which are separated at the connection point, into the corresponding waveguide sections of the polarizer with the same phase so that the waves are added together interference-free. Consequently, the weight the polarizer is relatively small.

The term "flat waveguide" in the context of the present invention is to be understood as an electro-magnetic waveguide with a rectangular cross-section. It can have the same dimensions as the waveguide to be connected to the corresponding connection point. With a correspondingly designed transition, the flat waveguide can also have smaller or larger dimensions than this waveguide.

The invention will be fully understood when reference is made to the following detailed description taken in conjunction with the accompanying drawings.

DETAILED DESCRIPTION OF THE INVENTION

Figure 1:
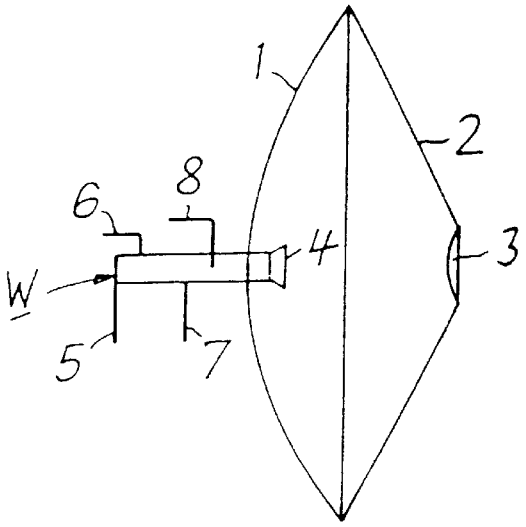
FIG. 1 is a schematic side view of an antenna with sub-reflector and polarizer.

The polarizer of the present invention can be used both for waves to be radiated from an antenna and also for waves to be received by the antenna. The polarizer is capable of separately guiding, for example, waves in the frequency band 3.6 to 4.2 GHz and in the frequency band 6.425 to 7.125 GHz. Of the two different frequency bands, the band with the lower frequencies will hereinafter be referred to as "lower band" and the band with the higher frequencies as "upper band". FIG. 1 depicts an antenna with a sub-reflector. However, the polarizer W can also be used for directly exciting an antenna.

The parabolic reflector of an antenna has the reference numeral 1. A sub-reflector 3 is connected to the parabolic reflector 1 via retaining members 2. A polarizer W which is formed as a waveguide section is attached in the center of the reflector 1. A feed horn 4 is attached to the waveguide section on the side facing the reflector 1. Also connected to the waveguide section are four waveguides 5, 6, 7 and 8. The installation and arrangement of the components of the antenna are known in the art and will not be described in detail.

Figure 2:
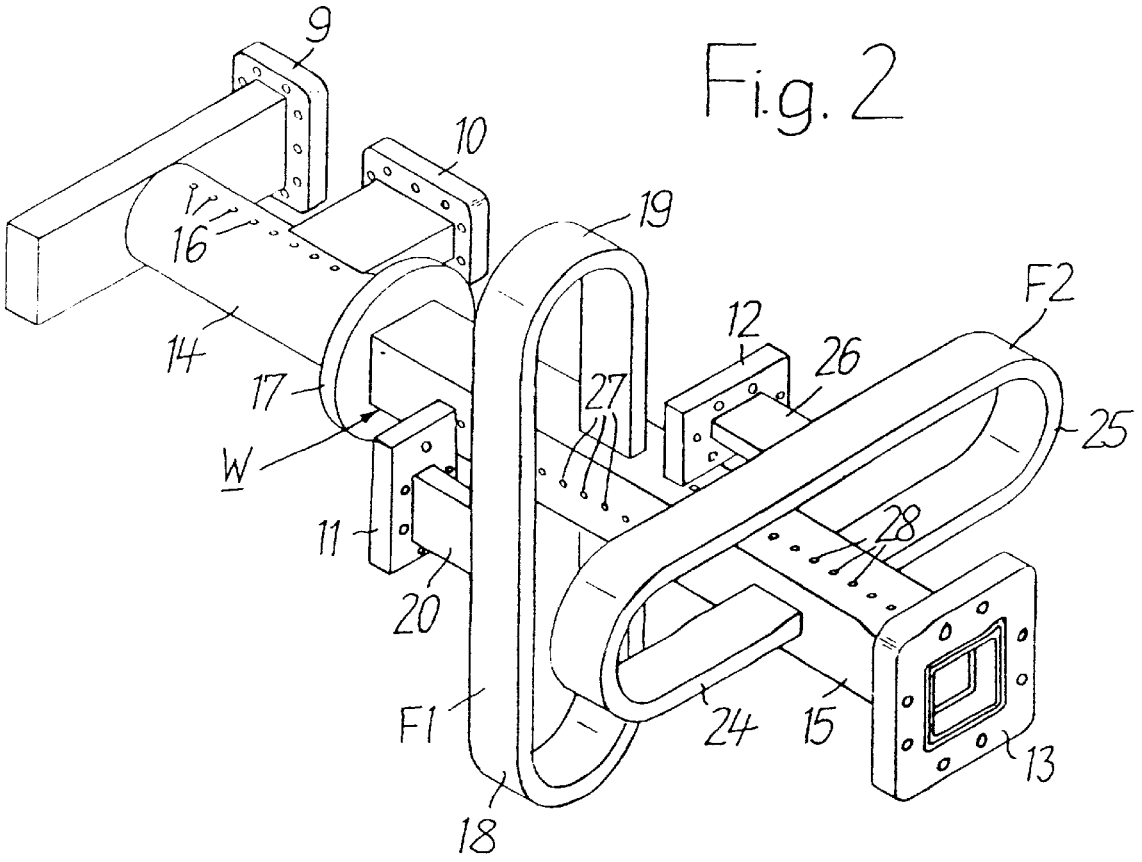
FIG. 2 is an enlarged perspective view of the polarizer of the invention.

The waveguides 5 and 6 are designed for the lower band, whereas the waves of the upper band are guided in the waveguides 7 and 8. The four waveguides 5 to 8 have a rectangular cross-section and are omitted from FIG. 2 for sake of simplicity. As shown in FIG. 2, the polarizer W is provided with four flanges 9, 10, 11 and 12 to each of which there is to be connected a respective waveguide 5 to 8 (see FIG. 1). The feed horn 4 (see FIG. 1) can be attached to flange 13.

The polarizer W consists of a region 14 for the lower band and a region 15 for the upper band. In the illustrated embodiment, the region 14 has the form of a circular waveguide. A square waveguide can also be used. The front face of waveguide 5 is to be connected to the polarizer W via the flange 9, whereas the waveguide 6 is to be terminated radially in the region 14 through flange 10. Indicated as circles 16 are short circuit and tuning elements which are required for interference-free propagation of the orthogonally polarized waves in the polarizer W.

The region 15 of the polarizer W can also be formed as a circular waveguide or as a square waveguide. In both cases the polarizer W can be formed as one piece. In the illustrated embodiment, the region 14 has a circular cross-section, whereas the region 15 has a square cross-section. A transition 17 with a lower reflectivity is disposed between the regions 14 and 15 of the polarizer W. The waveguide 7 is to be connected to the region 15 via the flange 11, while the waveguide 8 is to be connected to the region 15 via the flange 12.

Figure 3:
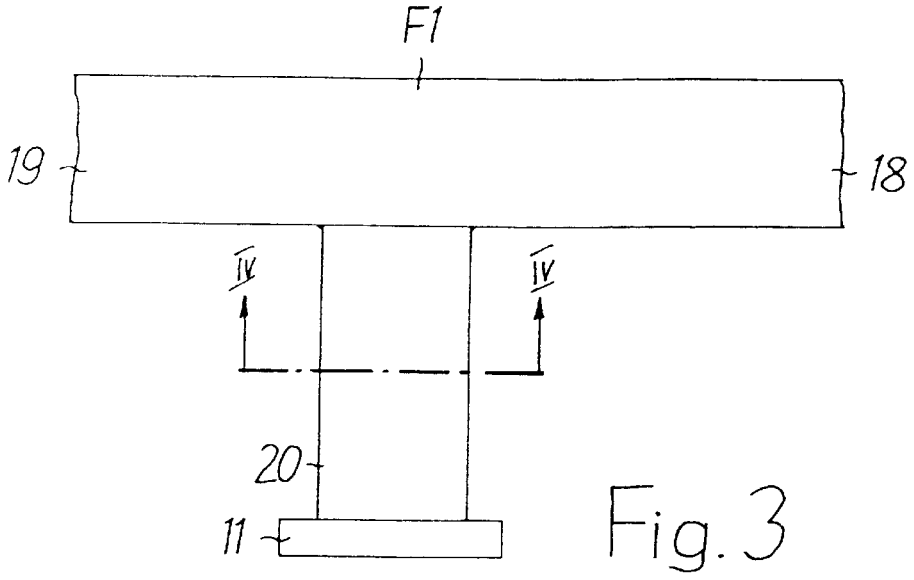
FIG. 3 is an enlarged side view of a portion of FIG. 2.

Since the waves of the lower band have to be guided also in the region 15 of the polarizer W, the region 15 has correspondingly large inside dimensions. The waves of the upper band therefore require a symmetric termination to prevent excitation of higher modes. From the connection point for the waveguide 7 formed by the flange 11, there extend two branches 18 and 19 which terminate in the region 15 of the polarizer W at two diametrically opposed points. The branches 18 and 19 are combined into one piece which is a flat waveguide F1 with a rectangular cross-section. A waveguide portion 20 projects outward from the flat waveguide F1 in a direction perpendicular thereto, with the flange 11 (see FIG. 3) attached to the free end of the waveguide region 20. The connecting point between the waveguide portion 20 and the flat waveguide F1 has the form of a "T", as illustrated in FIG. 3. At the connecting point, the waveguide portion 20 is located in the same plane as the flat waveguide F1 and is attached to a narrow side of the latter. The connecting point between the flat waveguide F1 and the waveguide portion 20 and their internal components are illustrated in detail with reference to FIGS. 4 and 6.

Figure 4:
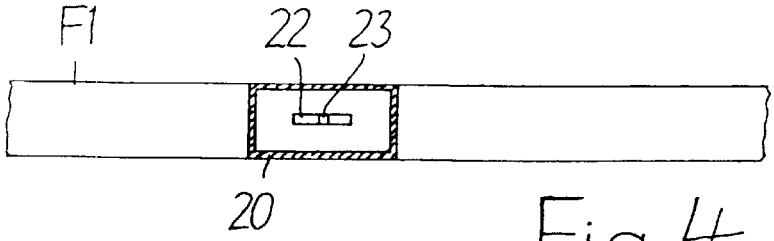
FIG. 4 is a cross-sectional view taken along the line IV—IV of FIG. 3.
Figure 5:
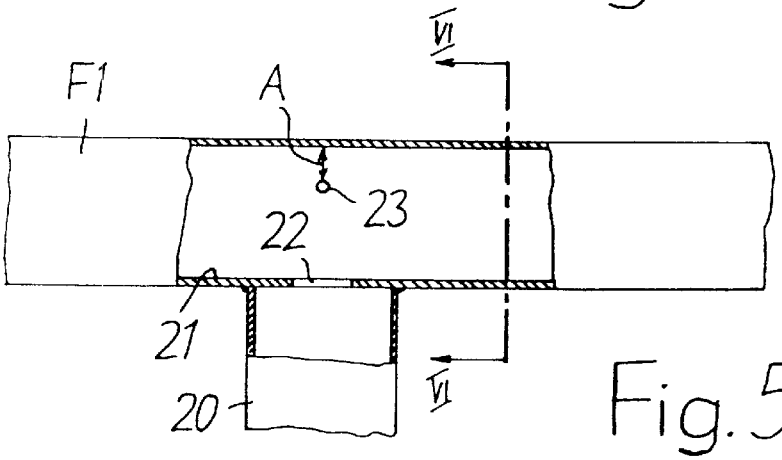
FIG. 5 is a view similar to FIG. 3 with a portion broken away to reveal internal structure.

Referring now to FIGS. 4 and 5, an aperture 22 is disposed in the wall 21 (see FIG. 5) of the flat waveguide F1. With the approximately rectangular opening in the wall 21, the electromagnetic waves can be fed into and decoupled from the flat waveguide F1 with low reflection losses. The aperture 22 is positioned symmetrically to the waveguide portion 20, i.e. the aperture 22 is symmetrically surrounded by the waveguide portion 20. The clear opening of the aperture 22 depends on the frequency of the electromagnetic waves to be transmitted.

Figure 6:
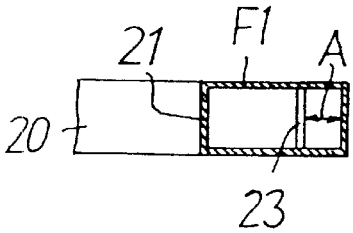
FIG. 6 is a cross-sectional view taken along the line VI—VI of FIG. 5.

Inside the flat waveguide F1, there is positioned a metal pin 23 operating as an inductive element. The pin 23 is located in the extension of the waveguide portion 20 and symmetrically thereto and therefore also symmetrically with respect to the aperture 22. As shown in FIG. 6, the pin 23 extends parallel to and over the entire height of the narrow sides of wall 21 in the respective flat waveguide F1. The pin 23 is spaced from the wall of the flat waveguide F1 opposite of the aperture 22 (see FIG. 5) by a distance A which is equal to one quarter of the average wavelength of the waves guided in the waveguide 7 (FIG. 1).

Through the cooperation of aperture 22 and pin 23, the waves fed via the waveguide 7 (FIG. 1) are split inside the flat waveguide F1 into two partial waves with equal power. These partial waves are guided onward in the two branches 18 and 19 (e.g. see FIG. 3) with equal power and fed with equal phase into the region 15 of polarizer W where the two partial waves are added (see FIG. 2). The same operating principle of the two branches 18 and 19 and the flat waveguide F1, respectively, with the connected waveguide portion 20 and pin 23 and aperture 22 applies to the other transmission direction as well.

As shown in FIG. 2, the two branches 24 and 25 extend from flange 12 to which the waveguide 8 (FIG. 1) is to be connected. They are again combined into a flat waveguide F2 to which a perpendicularly outwardly projecting waveguide portion 26 is connected. The flange 12 is located on the free end of the waveguide portion 26. The branches 24 and 25 terminate in the region 15 of polarizer W at two diametrically opposed locations. These locations are offset both in the axial direction of polarizer W and by 90° along the circumference. The operation and construction of the branches 24 and 25 is identical to that of branches 18 and 19 as described above. The circles 27 and 28 again indicate short-circuit and tuning elements which promote interference-free wave propagation.

The embodiment described above admirably achieves the objects of the invention. However, it will be appreciated that departures can be made by those skilled in the art without departing from the spirit and scope of the invention which is limited only by the following claims.

What is claimed is:

1. Polarizer for both a lower frequency band and an upper frequency band for exciting an antenna with a parabolic reflector, comprising:

(a) waveguide section for carrying two mutually perpendicularly linearly polarized waves for each of the upper and lower frequency bands, (b) means for connecting the waveguide section to two waveguides for the lower frequency band, the two lower frequency band waveguides being connected to the waveguide section separate from each other and mutually offset in an axial direction of the waveguide section;

(c) means adapted for connecting the waveguide section to two waveguides for the upper frequency band, said connecting means for the upper frequency band waveguides comprises a respective one-piece flat waveguide for each of the upper frequency band waveguides, the flat waveguides each have respective rectangular cross-sections, respective ends of the flat waveguides for each of the two upper frequency band waveguides terminating at two diametrically opposing locations on the waveguide section, the flat waveguides for the two upper frequency band waveguides further terminate on the waveguide section circumferentially offset relative to each other by 90°, said connecting means for the upper frequency band waveguides including a respective straight waveguide portion for each flat waveguide, each straight waveguide portion attached by a front face thereof to a narrow side wall of a respective one of the flat waveguides, the respective straight waveguide portions extend perpendicular from and coplanar with a corresponding one of the flat waveguides, respective free ends of the straight waveguide portions are adapted to be connected to the upper frequency waveguides, each of the flat waveguides has a respective aperture in a corresponding narrow side wall, each aperture is symmetrically surrounded by a corresponding one of the respective waveguide portions for providing low reflectivity matching; and (d) a respective metal pin in each of the flat waveguides located symmetrical to the respective aperture, each metal pin extending parallel to the narrow side walls of the respective flat waveguide and is spaced from a narrow side wall of the respective flat waveguide opposite of the narrow side wall with the respective aperture by a distance which is equal to one quarter of an average wavelength of the polarized waves of the upper frequency band.

2. Polarizer according to claim 1, wherein at least a region of the waveguide section has a circular cross-section.

3. Polarizer according to claim 1, wherein the waveguide section has a lower frequency band region with a circular cross-section, the waveguide section has an upper frequency band region with a square cross-section and a low reflectivity transition between the lower frequency band region and the upper frequency band region.

* * * * *

UNITED STATES PATENT AND TRADEMARK OFFICE

CERTIFICATE OF CORRECTION

PATENT NO. : 6,150,899
DATED : November 21, 2000
INVENTOR(S) : Udo Seewig et al.

It is certified that error appears in the above-identified patent and that said Letters Patent is hereby corrected as shown below:

Title page,
Under "FOREIGN PATENT DOCUMENTS", please add the following reference:

-- 2117980 10/1983 United Kingdom --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*